US008863558B2

(12) United States Patent
Janke et al.

(10) Patent No.: US 8,863,558 B2
(45) Date of Patent: Oct. 21, 2014

(54) LAUNDRY TREATING APPLIANCE AND METHOD OF OPERATION

(75) Inventors: Brian P. Janke, Saint Joseph, MI (US); Peter J. Richmond, Berrien Springs, MI (US); Peter E. Zasowski, Yantis, TX (US)

(73) Assignee: Whirlpool Corporation, Benton Harbor, MI (US)

( * ) Notice: Subject to any disclaimer, the term of this patent is extended or adjusted under 35 U.S.C. 154(b) by 34 days.

(21) Appl. No.: 13/545,411

(22) Filed: Jul. 10, 2012

(65) Prior Publication Data

US 2014/0013517 A1 Jan. 16, 2014

(51) Int. Cl.
*D06F 33/02* (2006.01)

(52) U.S. Cl.
USPC ..... 68/12.02; 68/24

(58) Field of Classification Search
USPC ..... 68/12.02, 12.04, 12.06, 23.1, 24; 8/158, 8/159
See application file for complete search history.

(56) References Cited

U.S. PATENT DOCUMENTS

| | | | | |
|---|---|---|---|---|
| 6,393,918 | B2 | 5/2002 | French et al. | |
| 7,000,436 | B2 | 2/2006 | Peterson | |
| 7,530,132 | B2 | 5/2009 | Kim | |
| 2003/0046962 | A1* | 3/2003 | Sonoda et al. | 68/12.06 |
| 2004/0211009 | A1* | 10/2004 | Murray et al. | 8/159 |
| 2005/0188473 | A1 | 9/2005 | Son et al. | |
| 2005/0204482 | A1* | 9/2005 | Murray et al. | 8/158 |
| 2006/0207299 | A1* | 9/2006 | Okazaki et al. | 68/12.02 |
| 2009/0090137 | A1 | 4/2009 | Jeong et al. | |
| 2009/0151085 | A1* | 6/2009 | Altinier et al. | 8/159 |
| 2010/0000022 | A1 | 1/2010 | Hendrickson et al. | |
| 2010/0000024 | A1 | 1/2010 | Hendrickson et al. | |
| 2010/0000264 | A1 | 1/2010 | Luckman et al. | |
| 2010/0000573 | A1 | 1/2010 | Hendrickson et al. | |
| 2010/0000581 | A1 | 1/2010 | Doyle et al. | |
| 2010/0000586 | A1 | 1/2010 | Hendrickson | |
| 2010/0263136 | A1* | 10/2010 | Ashrafzadeh et al. | 8/159 |
| 2011/0067186 | A1 | 3/2011 | Johansson | |

FOREIGN PATENT DOCUMENTS

| | | | |
|---|---|---|---|
| EP | 2175061 | B1 | 2/2011 |
| JP | 9299678 | A | 11/1997 |
| WO | 2010076158 | A1 | 7/2010 |

* cited by examiner

*Primary Examiner* — Joseph L Perrin

(57) ABSTRACT

A laundry treating appliance for treating a laundry load according to at least one cycle of operation and a method of operating a laundry treating appliance to determine a speed at which the laundry satellizes, comparing the same to a given amount or range, and altering execution of the at least one cycle of operation based on comparison such that the laundry treating appliance may be operated in an effective and efficient manner.

6 Claims, 4 Drawing Sheets

LAUNDRY TREATING APPLIANCE AND METHOD OF OPERATION

BACKGROUND

Laundry treating appliances, such as clothes washers, refreshers, and non-aqueous systems, may have a configuration based on a rotating drum that defines a treating chamber in which laundry items are placed for treating according to one or more cycles of operation. The laundry treating appliance may have a controller that implements the cycles of operation having one or more operating parameters. The controller may control a motor to rotate the drum according to one of the cycles of operation. The controller may control the motor to rotate the drum at the same speeds for a give cycle of operation regardless of the characteristics of the laundry items.

BRIEF SUMMARY

According to an embodiment of the invention, a method of operating a laundry treating appliance having a rotatable drum at least partially defining a treating chamber for receiving laundry for treatment according to at least one cycle of operation, includes determining an amount of the laundry in the treating chamber, setting a satellizing speed range based on the determined amount of laundry, accelerating the drum through a satellizing speed for the laundry, determining the speed at which the laundry satellizes to define a determined satellizing speed, comparing the determined satellizing speed to the satellizing speed range, and altering execution of the at least one cycle of operation when the determined satellizing speed is not within the satellizing speed range.

According to another embodiment of the invention, a laundry treating appliance for treating laundry according to at least one cycle of operation includes a rotatable drum at least partially defining a treating chamber, a motor rotationally driving the drum, a laundry size sensor, a speed sensor, and a controller receiving as inputs the size output and the speed output, and controlling the motor to control the rotational speed of the drum to implement the at least one cycle of operation by setting a satellizing speed range, accelerating the drum through a satellizing speed for the laundry, determining the rotational speed of the drum at which the laundry satellizes to define a determined satellizing speed, comparing the determined satellizing speed to the satellizing speed range, and altering execution of the at least one cycle of operation when the determined satellizing speed is not within the satellizing speed range.

DESCRIPTION OF EMBODIMENTS OF THE INVENTION

Figure 1:
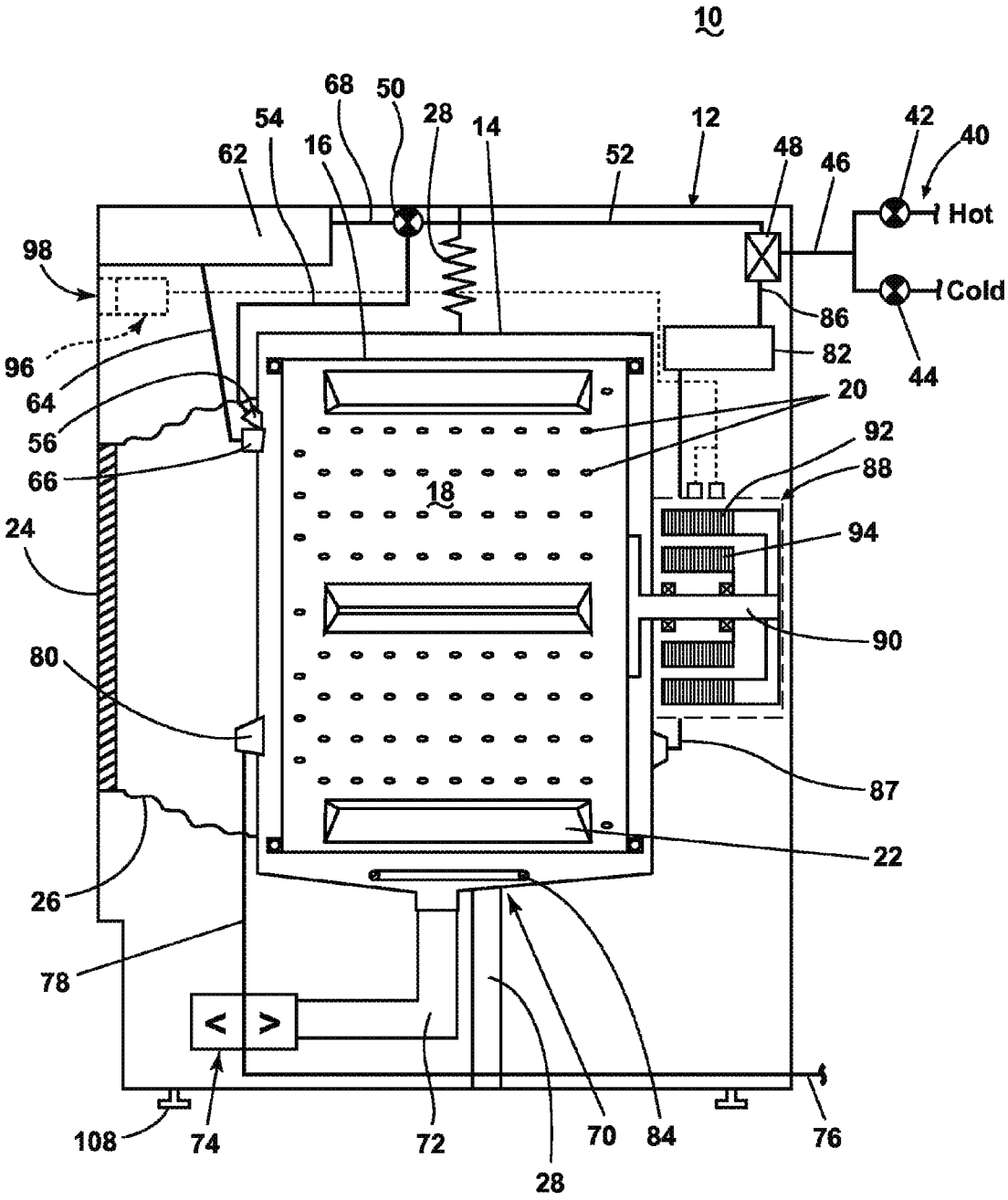
FIG. 1 is a schematic view of a laundry treating appliance in the form of a washing machine according to a first embodiment of the invention.

FIG. 1 is a schematic view of a laundry treating appliance according to a first embodiment of the invention. The laundry treating appliance may be any appliance which performs a cycle of operation to clean or otherwise treat items placed therein, non-limiting examples of which include a horizontal or vertical axis clothes washer; a combination washing machine and dryer; a dispensing dryer; a tumbling or stationary refreshing/revitalizing machine; an extractor; a non-aqueous washing apparatus; and a revitalizing machine.

The laundry treating appliance of FIG. 1 is illustrated as a washing machine 10, which may include a structural support system comprising a cabinet 12 which defines a housing within which a laundry holding system resides. The cabinet 12 may be a housing having a chassis and/or a frame, defining an interior enclosing components typically found in a conventional washing machine, such as motors, pumps, fluid lines, controls, sensors, transducers, and the like. Such components will not be described further herein except as necessary for a complete understanding of the invention.

The laundry holding system comprises a tub 14 supported within the cabinet 12 by a suitable suspension system and a drum 16 provided within the tub 14, the drum 16 defining at least a portion of a laundry treating chamber 18. The drum 16 may include a plurality of perforations 20 such that liquid may flow between the tub 14 and the drum 16 through the perforations 20. A plurality of baffles 22 may be disposed on an inner surface of the drum 16 to lift the laundry load received in the treating chamber 18 while the drum 16 rotates. It is also within the scope of the invention for the laundry holding system to comprise only a tub with the tub defining the laundry treating chamber.

The laundry holding system may further include a door 24 which may be movably mounted to the cabinet 12 to selectively close both the tub 14 and the drum 16. A bellows 26 may couple an open face of the tub 14 with the cabinet 12, with the door 24 sealing against the bellows 26 when the door 24 closes the tub 14.

The washing machine 10 may further include a suspension system 28 for dynamically suspending the laundry holding system within the structural support system.

The washing machine 10 may further include a liquid supply system for supplying water to the washing machine 10 for use in treating laundry during a cycle of operation. The liquid supply system may include a source of water, such as a household water supply 40, which may include separate valves 42 and 44 for controlling the flow of hot and cold water, respectively. Water may be supplied through an inlet conduit 46 directly to the tub 14 by controlling first and second diverter mechanisms 48 and 50, respectively. The diverter mechanisms 48, 50 may be a diverter valve having two outlets such that the diverter mechanisms 48, 50 may selectively direct a flow of liquid to one or both of two flow paths. Water from the household water supply 40 may flow through the inlet conduit 46 to the first diverter mechanism 48 which may direct the flow of liquid to a supply conduit 52. The second diverter mechanism 50 on the supply conduit 52 may direct the flow of liquid to a tub outlet conduit 54 which may be provided with a spray nozzle 56 configured to spray the flow of liquid into the tub 14. In this manner, water from the household water supply 40 may be supplied directly to the tub 14.

The washing machine 10 may also be provided with a dispensing system for dispensing treating chemistry to the treating chamber 18 for use in treating the laundry according to a cycle of operation. The dispensing system may include a dispenser 62 which may be a single use dispenser, a bulk dispenser or a combination of a single and bulk dispenser. Non-limiting examples of suitable dispensers are disclosed in U.S. Pub. No. 2010/0000022 to Hendrickson et al., filed Jul. 1, 2008, entitled "Household Cleaning Appliance with a Dispensing System Operable Between a Single Use Dispensing System and a Bulk Dispensing System," U.S. Pub. No. 2010/0000024 to Hendrickson et al., filed Jul. 1, 2008, entitled "Apparatus and Method for Controlling Laundering Cycle by Sensing Wash Aid Concentration," U.S. Pub. No. 2010/0000573 to Hendrickson et al., filed Jul. 1, 2008, entitled "Apparatus and Method for Controlling Concentration of Wash Aid in Wash Liquid," U.S. Pub. No. 2010/0000581 to Doyle et al., filed Jul. 1, 2008, entitled "Water Flow Paths in a Household Cleaning Appliance with Single Use and Bulk Dispensing," U.S. Pub. No. 2010/0000264 to Luckman et al., filed Jul. 1, 2008, entitled "Method for Converting a Household Cleaning Appliance with a Non-Bulk Dispensing System to a Household Cleaning Appliance with a Bulk Dispensing System," U.S. Pub. No. 2010/0000586 to Hendrickson, filed Jun. 23, 2009, entitled "Household Cleaning Appliance with a Single Water Flow Path for Both Non-Bulk and Bulk Dispensing," and application Ser. No. 13/093,132, filed Apr. 25, 2011, entitled "Method and Apparatus for Dispensing Treating Chemistry in a Laundry Treating Appliance," which are herein incorporated by reference in full.

Regardless of the type of dispenser used, the dispenser 62 may be configured to dispense a treating chemistry directly to the tub 14 or mixed with water from the liquid supply system through a dispensing outlet conduit 64. The dispensing outlet conduit 64 may include a dispensing nozzle 66 configured to dispense the treating chemistry into the tub 14 in a desired pattern and under a desired amount of pressure. For example, the dispensing nozzle 66 may be configured to dispense a flow or stream of treating chemistry into the tub 14 by gravity, i.e. a non-pressurized stream. Water may be supplied to the dispenser 62 from the supply conduit 52 by directing the diverter mechanism 50 to direct the flow of water to a dispensing supply conduit 68.

Non-limiting examples of treating chemistries that may be dispensed by the dispensing system during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The washing machine 10 may also include a recirculation and drain system for recirculating liquid within the laundry holding system and draining liquid from the washing machine 10. Liquid supplied to the tub 14 through tub outlet conduit 54 and/or the dispensing supply conduit 68 typically enters a space between the tub 14 and the drum 16 and may flow by gravity to a sump 70 formed in part by a lower portion of the tub 14. The sump 70 may also be formed by a sump conduit 72 that may fluidly couple the lower portion of the tub 14 to a pump 74. The pump 74 may direct liquid to a drain conduit 76, which may drain the liquid from the washing machine 10, or to a recirculation conduit 78, which may terminate at a recirculation inlet 80. The recirculation inlet 80 may direct the liquid from the recirculation conduit 78 into the drum 16. The recirculation inlet 80 may introduce the liquid into the drum 16 in any suitable manner, such as by spraying, dripping, or providing a steady flow of liquid. In this manner, liquid provided to the tub 14, with or without treating chemistry may be recirculated into the treating chamber 18 for treating the laundry within.

The liquid supply and/or recirculation and drain system may be provided with a heating system which may include one or more devices for heating laundry and/or liquid supplied to the tub 14, such as a steam generator 82 and/or a sump heater 84. Liquid from the household water supply 40 may be provided to the steam generator 82 through the inlet conduit 46 by controlling the first diverter mechanism 48 to direct the flow of liquid to a steam supply conduit 86. Steam generated by the steam generator 82 may be supplied to the tub 14 through a steam outlet conduit 87. The steam generator 82 may be any suitable type of steam generator such as a flow through steam generator or a tank-type steam generator. Alternatively, the sump heater 84 may be used to generate steam in place of or in addition to the steam generator 82. In addition or alternatively to generating steam, the steam generator 82 and/or sump heater 84 may be used to heat the laundry and/or liquid within the tub 14 as part of a cycle of operation.

Additionally, the liquid supply and recirculation and drain system may differ from the configuration shown in FIG. 1, such as by inclusion of other valves, conduits, treating chemistry dispensers, sensors, such as water level sensors and temperature sensors, and the like, to control the flow of liquid through the washing machine 10 and for the introduction of more than one type of treating chemistry.

The washing machine 10 also includes a drive system for rotating the drum 16 within the tub 14. The drive system may include a motor 88, which may be directly coupled with the drum 16 through a drive shaft 90 to rotate the drum 16 about a rotational axis during a cycle of operation. The motor 88 may be a brushless permanent magnet (BPM) motor having a stator 92 and a rotor 94. Alternately, the motor 88 may be coupled to the drum 16 through a belt and a drive shaft to rotate the drum 16, as is known in the art. Other motors, such as an induction motor or a permanent split capacitor (PSC) motor, may also be used. The motor 88 may rotationally drive the drum 16 including that the motor 88 may rotate the drum 16 at various speeds in either rotational direction.

The washing machine 10 also includes a control system for controlling the operation of the washing machine 10 to implement one or more cycles of operation. The control system may include a controller 96 located within the cabinet 12 and a user interface 98 that is operably coupled with the controller 96. The user interface 98 may include one or more knobs, dials, switches, displays, touch screens and the like for communicating with the user, such as to receive input and provide output. The user may enter different types of information including, without limitation, cycle selection and cycle parameters, such as cycle options.

The controller 96 may include the machine controller and any additional controllers provided for controlling any of the components of the washing machine 10. For example, the controller 96 may include the machine controller and a motor controller. Many known types of controllers may be used for the controller 96. The specific type of controller is not germane to the invention. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), may be used to control the various components.

Figure 2:
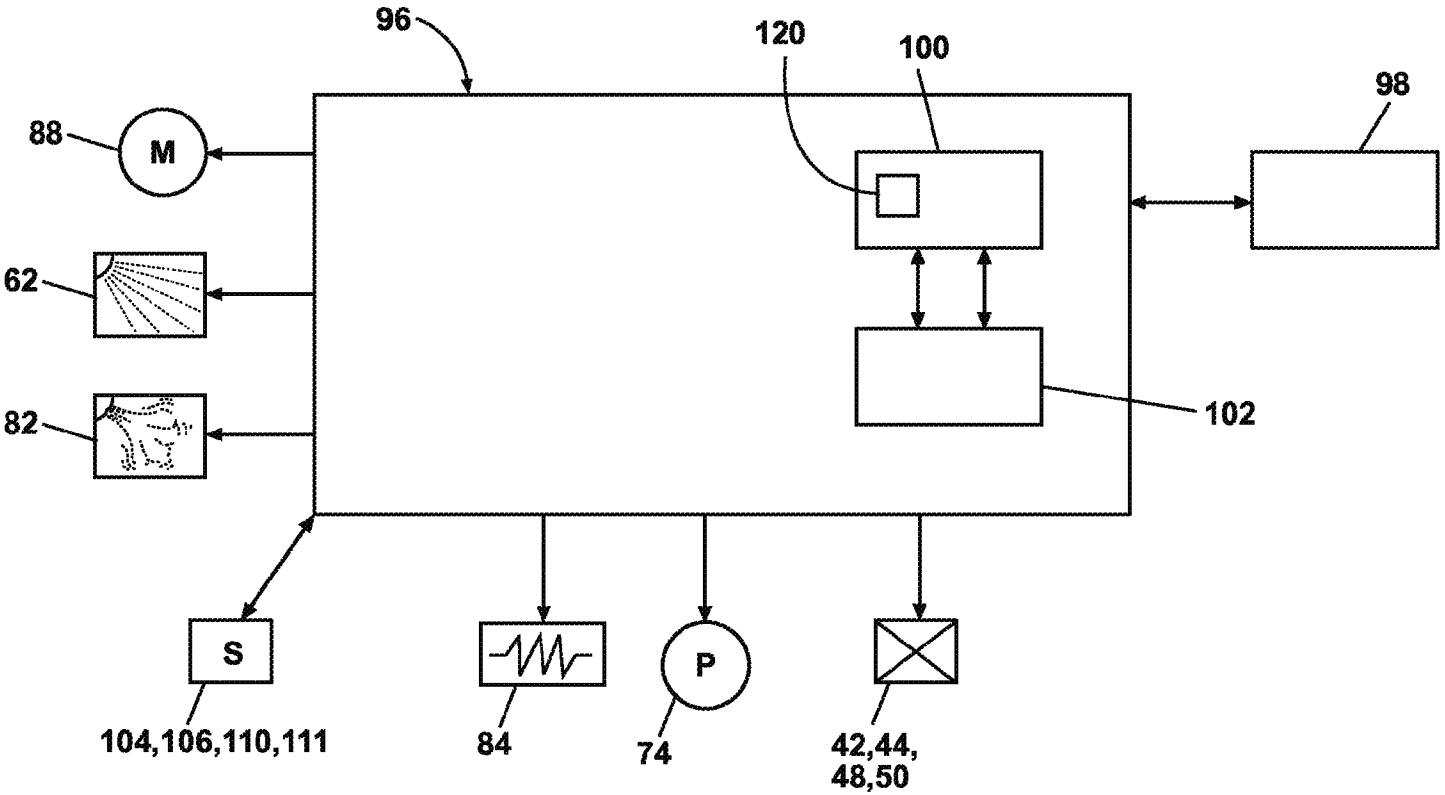
FIG. 2 is a schematic of a control system of the laundry treating appliance of FIG. 1 according to the first embodiment of the invention.

As illustrated in FIG. 2, the controller 96 may be provided with a memory 100 and a central processing unit (CPU) 102. The memory 100 may be used for storing the control software that is executed by the CPU 102 in completing a cycle of operation using the washing machine 10 and any additional software. Examples, without limitation, of cycles of operation include: wash, heavy duty wash, delicate wash, quick wash, pre-wash, refresh, rinse only, and timed wash. The memory 100 may also be used to store information, such as a database or table, and to store data received from one or more components of the washing machine 10 that may be communicably coupled with the controller 96. The database or table may be used to store the various operating parameters for the one or more cycles of operation, including factory default values for the operating parameters and any adjustments to them by the control system or by user input. For example, a table 120 may include a table of a plurality of satellizing speed ranges.

The controller 96 may be operably coupled with one or more components of the washing machine 10 for communicating with and controlling the operation of the component to complete a cycle of operation. For example, the controller 96 may be operably coupled with the motor 88, the pump 74, the dispenser 62, the steam generator 82 and the sump heater 84 to control the operation of these and other components to implement one or more of the cycles of operation.

The controller 96 may also be coupled with one or more sensors 104 provided in one or more of the systems of the washing machine 10 to receive input from the sensors, which are known in the art and not shown for simplicity. Non-limiting examples of sensors 104 that may be communicably coupled with the controller 96 include: a treating chamber temperature sensor, a moisture sensor, a weight sensor, a chemical sensor, a position sensor, an imbalance sensor, and a motor torque sensor, which may be used to determine a variety of system and laundry characteristics, such as laundry load inertia or mass.

In one example, one or more load size sensors or load amount sensors 106 may also be included in the washing machine 10 and may be positioned in any suitable location for detecting the amount of laundry, either quantitative (inertia, mass, weight, etc.) or qualitative (small, medium, large, etc.) within the treating chamber 18. The load amount sensors 106 may provide a size output to the controller 96 indicative of an amount of the laundry in the treating chamber 18. By way of non-limiting example, it is contemplated that the amount of laundry in the treating chamber may be determined based on the weight of the laundry and/or the volume of laundry in the treating chamber. Thus, the one or more load amount sensors 106 may output a signal indicative of either the weight of the laundry load in the treating chamber 18 or the volume of the laundry load in the treating chamber 18.

The one or more load amount sensors 106 may be any suitable type of sensor capable of measuring the weight or volume of laundry in the treating chamber 18. Non-limiting examples of load amount sensors 106 for measuring the weight of the laundry may include load volume, pressure, or force transducers which may include, for example, load cells and strain gauges. It has been contemplated that the one or more such load amount sensors 106 may be operably coupled to the suspension system 28 to sense the weight borne by the suspension system 28. The weight borne by the suspension system 28 correlates to the weight of the laundry loaded into the treating chamber 18 such that the load amount sensor 106 may indicate the weight of the laundry loaded in the treating chamber 18. In the case of a suitable load amount sensor 106 for determining volume it is contemplated that an IR or optical based sensor may be used to determine the volume of laundry located in the treating chamber 18.

Alternatively, it has been contemplated that the washing machine 10 may have one or more pairs of feet 108 (FIG. 1) extending from the cabinet 12 and supporting the cabinet 12 on the floor and that a weight sensor (not shown) may be operably coupled to at least one of the feet 108 to sense the weight borne by that foot 108, which correlates to the weight of the laundry loaded into the treating chamber 18. In another example, the amount of laundry within the treating chamber 18 may be determined based on motor sensor output, such as output from a motor torque sensor. The motor torque is a function of the inertia of the rotating drum and laundry. There are many known methods for determining the load inertia, and thus the load mass, based on the motor torque. It will be understood that the details of the load amount sensors are not germane to the embodiments of the invention and that any suitable method and sensors may be used to determine the amount of laundry.

As another example, a speed sensor 111 may also be included in the washing machine 10 and may be positioned in any suitable location for detecting and indicating a speed output indicative of a rotational speed of the drum 16. Such a speed sensor 111 may be any suitable speed sensor capable of providing an output indicative of the speed of the drum 16. It is also contemplated that the rotational speed of the drum 16 may also be determined based on a motor speed; thus, the speed sensor 111 may include a motor speed sensor for determining a speed output indicative of the rotational speed of the motor 88. The motor speed sensor may be a separate component, or may be integrated directly into the motor 88. Regardless of the type of speed sensor employed, or the coupling of the drum 16 with the motor 88, the speed sensor 111 may be adapted to enable the controller 96 to determine the rotational speed of the drum 16 from the rotational speed of the motor 88.

The previously described washing machine 10 may be used to implement one or more embodiments of the invention. The embodiments of the method of the invention may be used to control the operation of the washing machine 10 to alter execution of the at least one cycle of operation when a determined satellizing speed is not within the satellizing speed range. Such alteration may prove beneficial as the determined satellizing speed may be used in other aspects of the cycle of operation such as when laundry is being distributed within the treating chamber 18 to provide for an acceptable amount of imbalance.

Prior to describing a method of operation of the washing machine 10, a brief summary of the underlying physical phenomena may be useful to aid in the overall understanding. The motor 88 may rotate the drum 16 at various speeds in either rotational direction. In particular, the motor 88 can rotate the drum 16 at speeds to effect various types of laundry load 112 movement inside the drum 16. For example, the laundry load may undergo at least one of tumbling, rolling (also called balling), sliding, satellizing (also called plastering), and combinations thereof. During tumbling, the drum 16 is rotated at a tumbling speed such that the fabric items in the drum 16 rotate with the drum 16 from a lowest location of the drum 16 towards a highest location of the drum 16, but fall back to the lowest location before reaching the highest location. Typically, the centrifugal force applied by the drum to the fabric items at the tumbling speeds is less than about 1G. During satellizing, the motor 88 may rotate the drum 16 at rotational speeds, i.e. a spin speed, wherein the fabric items are held against the inner surface of the drum and rotate with the drum 16 without falling. This is known as the laundry being satellized or plastered against the drum. Typically, the force applied to the fabric items at the satellizing speeds is greater than or about equal to 1G. For a horizontal axis washing machine 10, the drum 16 may rotate about an axis that is inclined relative to the horizontal, in which case the term "1G" refers to the vertical component of the centrifugal force vector, and the total magnitude along the centrifugal force vector would therefore be greater than 1G. The terms tumbling, rolling, sliding and satellizing are terms of art that may be used to describe the motion of some or all of the fabric items forming the laundry load. However, not all of the fabric items forming the laundry load need exhibit the motion for the laundry load to be described accordingly. Further, the rotation of the fabric items with the drum 16 may be facilitated by the baffles 22.

Centrifugal force (CF) is a function of a mass (m) of an object (laundry item 116), an angular velocity (ω) of the object, and a distance, or radius (r) at which the object is located with respect to an axis of rotation, or a drum axis. Specifically, the equation for the centrifugal force (CF) acting on a laundry item 116 within the drum 16 is:

$$CF=m*\omega^2*r \quad (1)$$

The centrifugal force (CF) acting on any single item 116 in the laundry load 112 can be modeled by the distance the center of gravity of that item 116 is from the axis of rotation of the drum 16. Thus, when the laundry items 116 are stacked upon each other, which is often the case, those items having a center of gravity closer to the axis of rotation experience a smaller magnitude centrifugal force (CF) than those items having a center of gravity farther away. It is possible to slow the speed of rotation of the drum 16 such that the closer items 116 will experience a centrifugal force (CF) less than the force required to satellize them, permitting them to tumble, while the farther away items 116 still experience a centrifugal force (CF) equal to or greater than the force required to satellize them, retaining them in a fixed position relative to the drum 16. Using such a control of the speed of the drum 16, it is possible to control the speed of the drum 16 such that the closer items 116 may tumble within the drum 16 while the farther items 116 remain fixed. This method may be used to eliminate an imbalance 114 caused by a mass of stacked laundry items 116 because an imbalance is often caused by a localized "piling" of items 116.

As used in this description, the elimination of the imbalance 114 means that the imbalance 114 is reduced below a maximum magnitude suitable for the operating conditions. It does not require a complete removal of the imbalance 114. In many cases, the suspension system 28 in the washing machine 10 may accommodate a certain amount of imbalance 114. Thus, it is not necessary to completely remove the entire imbalance 114.

Figure 3:
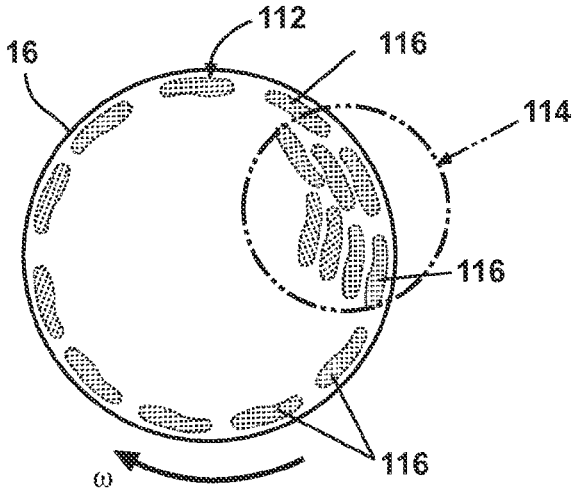
FIG. 3 illustrates a laundry load, including an imbalance, in a drum of the laundry treating appliance of FIG. 1, during a spin phase of a cycle of operation.
Figure 4:
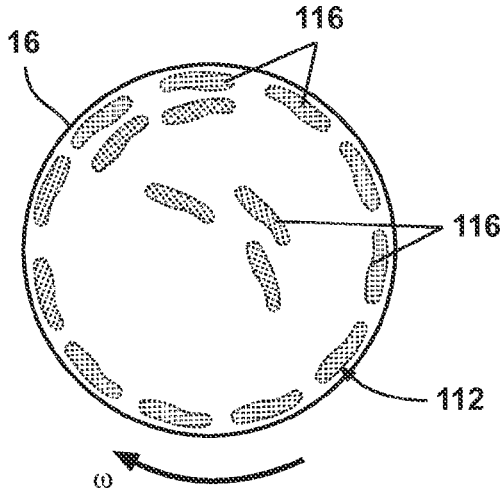
FIG. 4 illustrates the position of the laundry load in the drum as it is redistributed during the cycle of operation.
Figure 5:
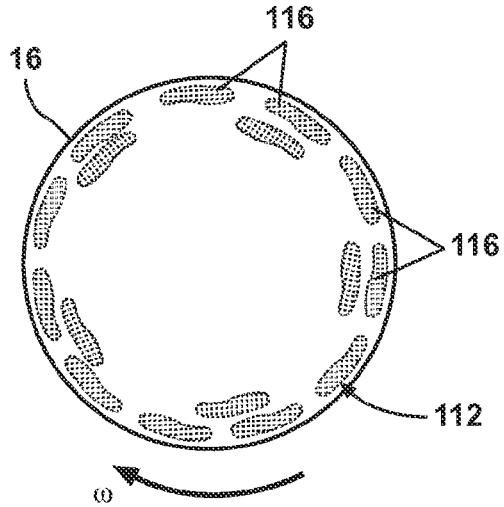
FIG. 5 illustrates the position of the laundry load in the drum after the imbalance has been sufficiently eliminated.

FIGS. 3-5 graphically illustrate such a method. Beginning with FIG. 3, an unequally distributed laundry load 112 is shown in the treating chamber 18 defined by the drum 16 during a spin phase wherein the treating chamber 18 is rotated at a spin speed sufficient to apply a centrifugal force greater than that required to satellize the entire laundry load 112, thereby, satellizing the laundry load 112. However, it can also be seen that not all the laundry items 116 that make up the laundry load 112 are located an equal distance from the axis of rotation. Following the above equation, the centrifugal force (CF) acting on each laundry item 116 in the treating chamber 18 is proportional to the distance from the axis of rotation. Thus, along the radius of the treating chamber 18, the centrifugal force (CF) exhibited on the individual laundry items 116 will vary. Accordingly, the closer the laundry item 116 lies to the axis of rotation, the smaller the centrifugal force (CF) acting thereon. Therefore, to satellize all of the laundry items 116, the treating chamber 18 must be rotated at a spin speed sufficient that the centrifugal force (CF) acting on all of the laundry items 116 is greater than the gravity force acting thereon. It can be correlated that the laundry items 116 pressed against the inner peripheral wall of the treating chamber 18 experience greater centrifugal force (CF) than the laundry items 116 lying closer to the axis of rotation. In other words, during the spin phase and satellization of the laundry load 112, all of the laundry items 116 are experiencing centrifugal force greater than the force required to satellize them, yet not all of the laundry items 116 are experiencing the same centrifugal force (CF).

The imbalance 114 can be seen in the treating chamber 18, as circled in FIG. 3. The imbalance 114 is due to the uneven distribution of the laundry items 116 within the treating chamber 18. Further, the laundry items 116 that create the imbalance 114 will necessarily be those laundry items 116 that are closest to the axis of rotation. FIG. 4 illustrates the position of the laundry load 112 in the treating chamber 18 during a redistribution phase wherein the treating chamber 18 is slowed from the speed of FIG. 3 and rotated at a speed such that some of the laundry items 116 experience less than a centrifugal force required to satellize them, while the remaining laundry items 116 experience a centrifugal force required to satellize them or greater than a centrifugal force required to satellize them. According to the principals described above, as the rotational speed of the treating chamber 18 is reduced, the laundry item 116 or items that contributed to the imbalance 114 will begin to tumble and will be redistributed. Upon redistribution, the treating chamber 18 may be accelerated once again to a speed sufficient to satellize all of the laundry items 116. FIG. 5 illustrates the position where the imbalance 114 is eliminated by a sufficient redistribution and the rotational speed of the treating chamber 18 has been increased again to the spin speed sufficient to satellize the entire laundry load 112.

The deceleration of the drum 16 and acceleration of the drum 16 may include the controller 96 operating the motor 88 such that the speed of the drum 16 is dropped just below the satellizing speed and then brought back up to the satellizing speed such that the speed of the drum 16 oscillates around the satellizing speed, this is sometimes referred to as a short distribution. Alternatively, the deceleration of the drum 16 and acceleration of the drum 16 may include the controller 96 stopping the rotation of the drum 16 altogether and then bringing the drum 16 back up to the satellizing speed, this is sometimes referred to as a long distribution. Regardless of the type of distribution, an accurate satellizing speed is beneficial for the controller 96 to have and use. If the determined satellizing speed is lower than the actual satellizing speed, the controller 96 may attempt to satellize the laundry items and the laundry items may instead tumble. If the determined satellizing speed is higher than the actual satellizing speed, the controller 96 may attempt to redistribute the laundry by tumbling some of the laundry items and the laundry items may instead remain plastered to the drum 16.

Figure 6:
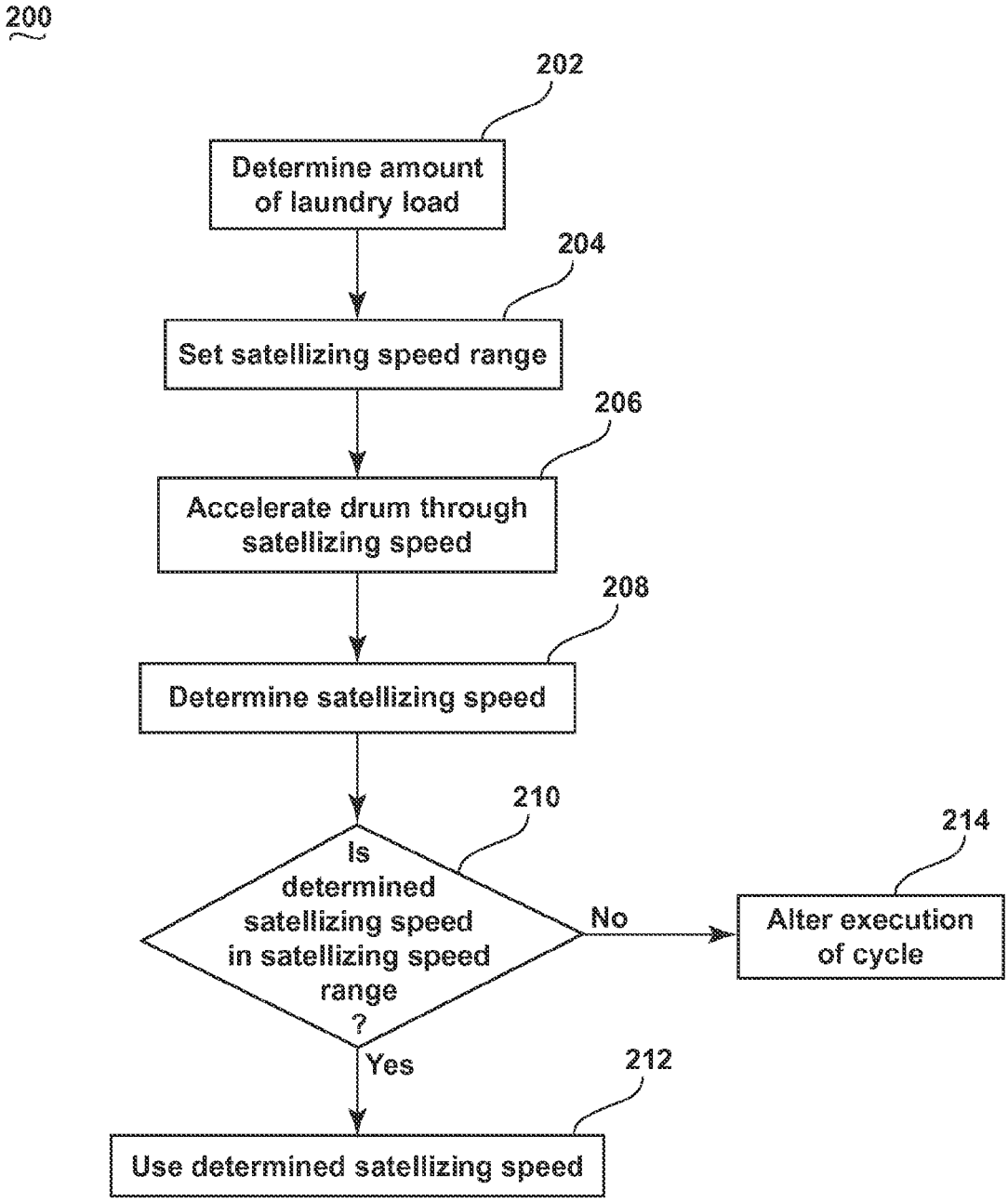
FIG. 6 is a flow chart illustrating a method of operating the washing machine according to a second embodiment of the invention.

Referring now to FIG. 6, a flow chart of a method 200 for altering execution of the at least one cycle of operation of the washing machine 10 when the determined satellizing speed is not within a set satellizing speed range is illustrated. The sequence of steps depicted for this method is for illustrative purposes only, and is not meant to limit the method in any way as it is understood that the steps may proceed in a different logical order or additional or intervening steps may be included without detracting from the invention. The method 200 starts with assuming that the user has placed one or more laundry items 116 for treatment within the treating chamber 18 and selected a cycle of operation through the user interface 98. The method 200 may be implemented during any portion of a cycle of operation or may be implemented as a separate cycle of operation.

At 202, the controller 96 may determine an amount of the laundry load within the treating chamber 18. The amount of laundry may be qualitative or quantitative. For example, a qualitative determination of the laundry amount may include determining whether the laundry is an extra-small, small, medium, large or extra-large load, or any other suitable qualitative grouping. A quantitative determination may include determining a weight or volume of the laundry within the treating chamber 18. For example, the determining the amount of laundry may include determining a load mass of the laundry load. This may include determining an inertia value indicative of the inertia of the laundry load. Determining the inertia of the laundry may include determining the inertia of the laundry and/or determining the inertia of the rotating drum and laundry. The determination of the inertia value may be made during an acceleration ramp of the drum such as when the drum is being accelerated at 206 or at an initial acceleration of the drum used to determine the amount of the laundry load. The controller 96 may determine the inertia value by determining a motor torque and this may be determined based on a motor sensor output, such as output from a motor torque sensor. The motor torque may be a function of the inertia of the rotating drum and laundry load. Generally, the greater the inertia of the rotating drum and laundry, the greater the motor torque. There are many methods for determining the load inertia, and the load mass, based on the motor torque and such a determination method is not germane to the invention. The amount of laundry may also be determined manually based on user input through the user interface 98 or automatically by the washing machine 10 such as through the load amount sensors 106.

At 204, a satellizing speed range may be set by the controller 96 based on the amount of the laundry load determined at 202. More specifically, the controller 96 may set a satellizing speed range based on the size output from the size sensors 106. Setting the satellizing speed range may include selecting a predetermined satellizing speed range based on the determined amount of laundry, which may include selecting a predetermined satellizing speed range from a plurality of satellizing speed ranges. For example, the predetermined satellizing speed range may be found by the controller 96 conducting a table look-up of the satellizing speed range from a table of a plurality of satellizing speed ranges such as the table 120, which contains a plurality of satellizing speed ranges. In conducting a table look-up the controller 96 may determine the satellizing speed range based on where the determined amount of laundry falls within a range of amounts of laundry. For example, a predetermined satellizing speed range may be provided if the load amount falls in the range of an extra-small to a small load amount.

At 206, the controller 96 may accelerate the drum 16 through operation of the motor 88 through a satellizing speed for the laundry. Accelerating the drum 16 through the satellizing speed may include accelerating the drum 16 from a non-satellizing speed, where at least some of the laundry is not satellized. The drum 16 may be accelerated from the non-satellizing speed to a satellizing speed, where all of the laundry is satellized.

The controller 96 may accelerate the drum 16 through a satellizing speed for the laundry and may determine the rotational speed of the drum 16 at which the laundry satellizes to define a determined satellizing speed, as indicated at 208. For example, the controller 96 may determine the satellizing speed by determining a rotational speed of the drum 16 when a high frequency component of a torque signal of the motor 88 satisfies a reference value. By way of alternative example, the satellizing speed may be determined by determining a rotational speed of the drum 16 when the torque signal of motor 88 matches a reference torque signal. While the satellizing speed may be determined in either of these ways it will be understood that any method for determining the satellization speed may be used as the method of determining is not germane to the invention.

At 210, the controller 96 may compare the determined satellizing speed to the satellizing speed range. This comparison may include determining whether the determined satellizing speed falls within the satellizing speed range. The term "within" the satellizing speed range is used herein to mean including or excluding the upper and lower values of the range. The satellizing speed range and comparison may be presented in the controller 96 in any suitable manner including for example a formula or algorithm, a high and low point, a single point, a delta, etc.

If the determined satellizing speed falls within the satellizing speed range, then the controller may continue with the cycle of operation without alteration, as indicated at 212. This may include using the determined satellizing speed in any subsequent calculations or operations. If the determined satellizing speed falls outside the satellizing speed range, the controller 96 may alter execution of the at least one cycle of operation when the determined satellizing speed is not within the satellizing speed range as indicated at 214. The controller 96 may alter execution of the at least one cycle of operation in a variety of ways including by setting an operational parameter for the cycle of operation based on the comparison. In setting an operational parameter the controller 96 may use a default satellizing speed in place of the determined satellizing speed when the determined satellizing speed falls outside the satellizing speed range. This may ensure that any further uses of the satellizing speed such as for redistribution purposes uses a default value as opposed to the determined value. In such an instance the determined satellizing speed value may be discarded for the remainder of the cycle of operation. The controller 96 may alternatively, or in addition to using a default value, alter execution of the at least one cycle of operation by at least one of initiating, altering, and ceasing a phase of the at least one cycle of operation. For example, the controller 96 may initiate a re-distribution phase to redistribute the laundry within the treating chamber 18 when the satellizing speed falls outside the satellizing range. It is also contemplated that the satellizing speed ranges, including those in the table of a plurality of satellizing speed ranges may be updated based on determined satellizing speed ranges that are determined to be within the appropriate satellizing speed range. In this manner the speed ranges in the table 120 may be updated with historical spin speeds enabling the table 120 to be adapted to the specific loads run by the user over time.

It will be understood that the method 200 illustrated is merely for illustrative purposes. It is further noted that rarely is it necessary from a practical perspective to actually calculate the value at issue. For example, in the case of the amount of the load, motor torque and/or inertia are typically proportional to the amount, rendering unnecessary to actually calculate the amount. Further, the motor torque and/or inertia are typically proportional to a voltage level of an output signal from a sensor, such as a torque sensor. Thus, to determine the amount of laundry, one need only obtain the voltage value and compare it to a reference voltage value for the corresponding load amount. In all of the above cases the setting of the satellizing speed range based on the determined amount of laundry may include setting the satellizing speed range based on the voltage level instead of the corresponding load amount.

To the extent not already described, the different features and structures of the various embodiments may be used in combination with each other as desired. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

The above described embodiments provided a variety of benefits including that the cycle of operation of the laundry treating appliance may be operated in an effective and efficient manner. The embodiments of the invention described allow a determined satellizing speed to be verified for accuracy. The appliance may then use either the appropriate determined value or a corrected value in subsequent portions of the cycle of operation. For example, using either an appropriate determined value or a corrected value allows the laundry to be actually redistributed and more quickly redistributed than would occur if an unacceptable value were used.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A laundry treating appliance for treating laundry according to at least one cycle of operation, comprising:

a rotatable drum at least partially defining a treating chamber for receiving the laundry for treatment;

a motor rotationally driving the drum;

a laundry size sensor providing a size output indicative of an amount of the laundry in the treating chamber;

a speed sensor providing a speed output indicative of a rotational speed of the drum; and a controller receiving as inputs the size output and the speed output and controlling the motor to control the rotational speed of the drum to implement the at least one cycle of operation by setting a satellizing speed range based on the size output, accelerating the drum through an actual satellizing speed for the laundry regardless of the set satellizing speed range, determining the rotational speed of the drum at which the laundry actually satellizes to define a determined satellizing speed, comparing the determined satellizing speed to the satellizing speed range, and altering execution of the at least one cycle of operation when the determined satellizing speed is not within the satellizing speed range.

2. The laundry treating appliance of claim 1 wherein the controller sets the satellizing speed range by conducting a table lookup of the satellizing speed range from a table of a plurality of satellizing speed ranges from a memory containing the table.

3. The laundry treating appliance of claim 1 wherein the controller alters execution of the at least one cycle of operation by setting an operational parameter for the cycle of operation based on the comparison.

4. The laundry treating appliance of claim 3 wherein in setting the operational parameter the controller uses a default satellizing speed in place of the determined satellizing speed when the determined satellizing speed falls outside the satellizing speed range.

5. The laundry treating appliance of claim 1 wherein the controller alters execution of the at least one cycle of operation by at least one of initiating, altering, and ceasing a phase of the at least one cycle of operation.

6. The laundry treating appliance of claim 5 wherein the initiating the phase comprises the controller initiating a redistribution phase to redistribute the laundry within the treating chamber when the satellizing speed falls outside the satellizing range.

* * * * *